United States Patent [19]

Louis-Jeune

[11] Patent Number: 4,958,386

[45] Date of Patent: Sep. 25, 1990

[54] AEROBIC PANTS

[76] Inventor: Marc-Henri Louis-Jeune, P.O. Box 501, Allston, Mass. 02134

[21] Appl. No.: 219,447

[22] Filed: Jul. 14, 1988

[51] Int. Cl.[5] ..... A41D 1/06

[52] U.S. Cl. ..... 2/227; 2/247; 272/119

[58] Field of Search ..... 2/227, 238, 79, 81, 2/69, 102, 247, 250, 253; 272/119

[56] References Cited

U.S. PATENT DOCUMENTS 2,983,924 5/1961 Cohen et al. ..... 2/238 X
4,293,957 10/1981 Melarvie ..... 2/79 X
4,303,239 12/1981 Walsh ..... 2/22 X
4,382,302 5/1983 Watson ..... 272/119 X
4,384,369 5/1983 Prince ..... 2/81 X
4,602,387 7/1986 Zakrlewski ..... 272/119 X

*Primary Examiner*—Werner H. Schroeder
*Attorney, Agent, or Firm*—Irving M. Kriegsman

[57] ABSTRACT

Athletic legwear designed especially for use by a person while engaged in aerobic exercise includes a pair of pants of approximately knee-length. A plurality of pocket assemblies are removably attached to the pants between the waist and knee of the wearer, each pocket assembly having one or more pockets adapted to hold securely therein one or more weights.

9 Claims, 8 Drawing Sheets

AEROBIC PANTS

BACKGROUND OF THE INVENTION

The present invention relates generally to athletic apparel and more particularly to athletic legwear.

With focus on health and fitness becoming increasingly more prevalent over the last several years, it is not unexpected to discover that certain forms of aerobic exercise, such as walking and jogging, have become exceptionally popular. Aerobic exercise, as distinguished from anaerobic exercise (e.g. running at full speed or lifting heavy weights), is considered to be especially beneficial in improving one's health because during periods of aerobic exercise the heart is exercised in a vigorous but consistent manner. Apart from its cardiovascular benefits, aerobic exercise is also very effective at improving overall body conditioning and appearance.

Frequently, people who wish to direct the benefits of aerobic exercising at also improving specific parts of their body, such as their biceps and quadriceps, will carry weights while they are engaged in their exercising. Typically, those who desire bigger and stronger leg muscles have eithr wrapped weighted straps around their ankles, the straps being secured around their ankles with mating hook and loop patches, snaps or other similar types of fasteners, or have tied weights directly to their feet, securing the weights to their feet using a cast-like apparatus which is laced together like a sneaker. The weights in the straps and cast-like apparatus are usually removable (i.e. not permanently imbedded therein). One problem common with the use of ankleweight type device or weights attached to the feet is that it often causes knee and lower leg injuries. The reason for this is that the human leg is not able to withstand the torque produced by the placement of the weights at such a distance from the body's center gravity (i.e. the waist). Another problem, which pertains more to the strap approach than to the cast approach, is that the weight have a tendency to slide up and down the legs as the wearer exercises. This sliding motion frequently results in the irritation of skin covering the lower leg. Still other known arrangements for carrying weights while involved in aerobic exerises for the purpose of strengthening various muscles and/or ligaments in their bodies include using weighted wristband or weighted vests or simply carrying weights in the hands of the exerciser. The weights in such wristband and vests are usually permanently imbedded therein (i.e. cannot be removed).

Accordingly, there exists a need for an athletic legwear to be worn by person while engaged in aerobic exercise which strengthens the leg muscles while, at the same time, spares the wearer of considerable discomfort and the substantial risk of injury to the knee and lower leg.

It is therefore an object of the present invention to provide new and improved athletic legwear.

It is another object of this invention to provide an athletic legwear to be worn by a person while engaged in aerobic exercise which is safe, comfortable and effective at strengthening the leg muscles.

It is another object of the present invention to provide new and improved athletic legwear which is easy to manufacture, can be mass produced, and is simple to wear.

It is still another object of the present invention to new and improved athletic legwear which is constructed out of a minimal number of parts.

It is still yet another object of the present invention to provide new and improved legwear which is durable and easy to wash.

It is a further object of this invention to provide a new and improved arrangement for carrying weights while engaged in aerobic exercise.

It is still a further object of this invention to provide a new and improved legwear.

It is another object of this invention to provide a new and improved method for strengthening the leg muscles of a person while engaged in aerobic exercising.

It is a further object of this invention to provide a new and improved pair of pants.

SUMMARY OF THE INVENTION

Athletic legwear constructed according to the teachings of the present invention comprises a pair of pants on which are mounted one or more pocket assemblies, each pocket assembly having one or more pockets adapted to hold securely therein one or more weights. The pocket assemblies are mounted on the pair of pants at locations so as to be above the knee and below the waist of the wearer. In one embodiment of the invention the pocket asssemblies are removably attached to the pair of pants in another embodiment of the invention the pocket assemblies are permanently attached to the pair of pants.

The present invention is based in part in the discovery that the leg muscles can be strengthened in a most satisfactory manner by carrying weights between the waist and the knee while engaged in aerobic exercise.

Various features and advantages will appear from the description to follow. In the description, reference is made to the accompanying drawings which forms a part thereof, and which are shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefor, not to be taken in a limiting sense, and the scope of the present invention is best defined by the appended claims.

BRIEF DESCRIPTION OF THE DRAWINGS

For a fuller understanding of the nature and objects of the invention, reference should be made to the following detailed description taken in conjunction with the accompanying drawings wherein:

FIG. 4(*a*) is a perspective view of one of the auxiliary belts shown in FIG. 1;

FIG. 8(*b*) is a rear perspective view of the athletic legwear shown in FIG. 1 with the pocket assemblies removed;

FIG. 11(*a*) is a perspective view of a person wearing another embodiment of the invention;

DETAILED DESCRIPTION OF PREFERRED EMBODIMENTS

Figure 11A:
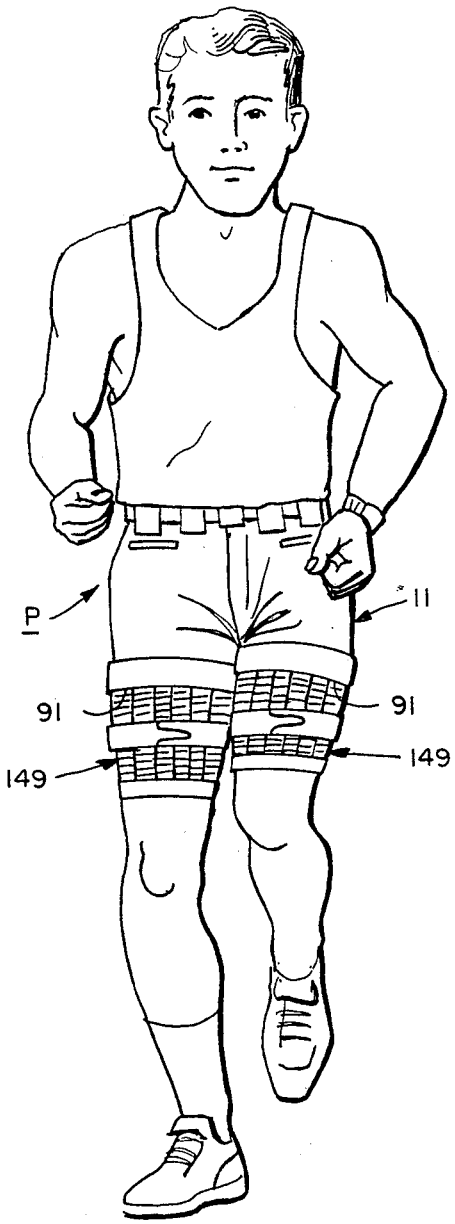
FIG. 11 is an enlarged front view of one of the pocket assemblies shown in FIG. 1, with the weights partially inserted into the pockets formed therein.
Figure 1:
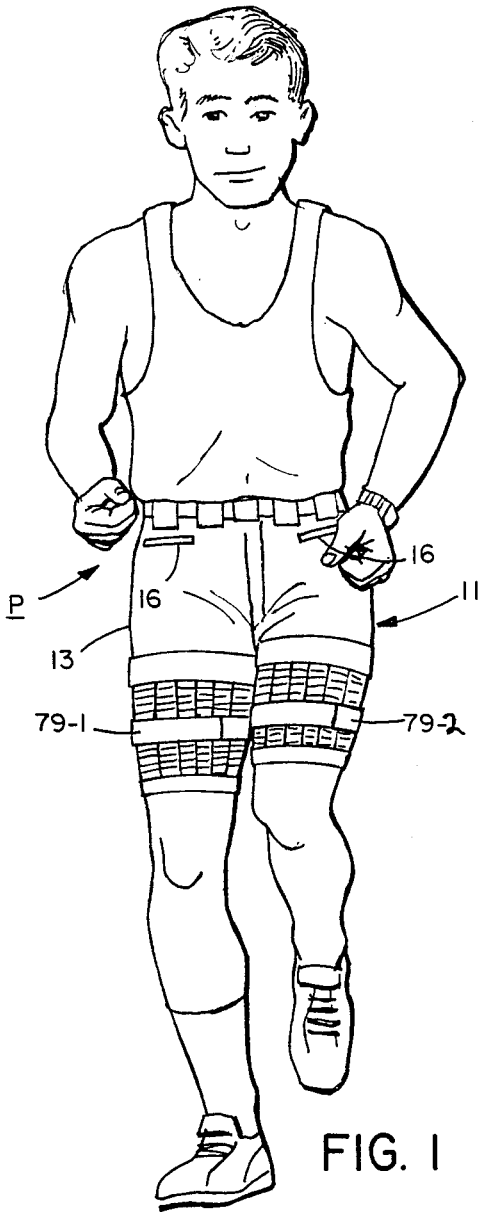
FIG. 1 is a perspective view taken from the front of a person wearing one embodiment of an athletic legwear constructed according to the teachings of the present invention.
Figure 2:
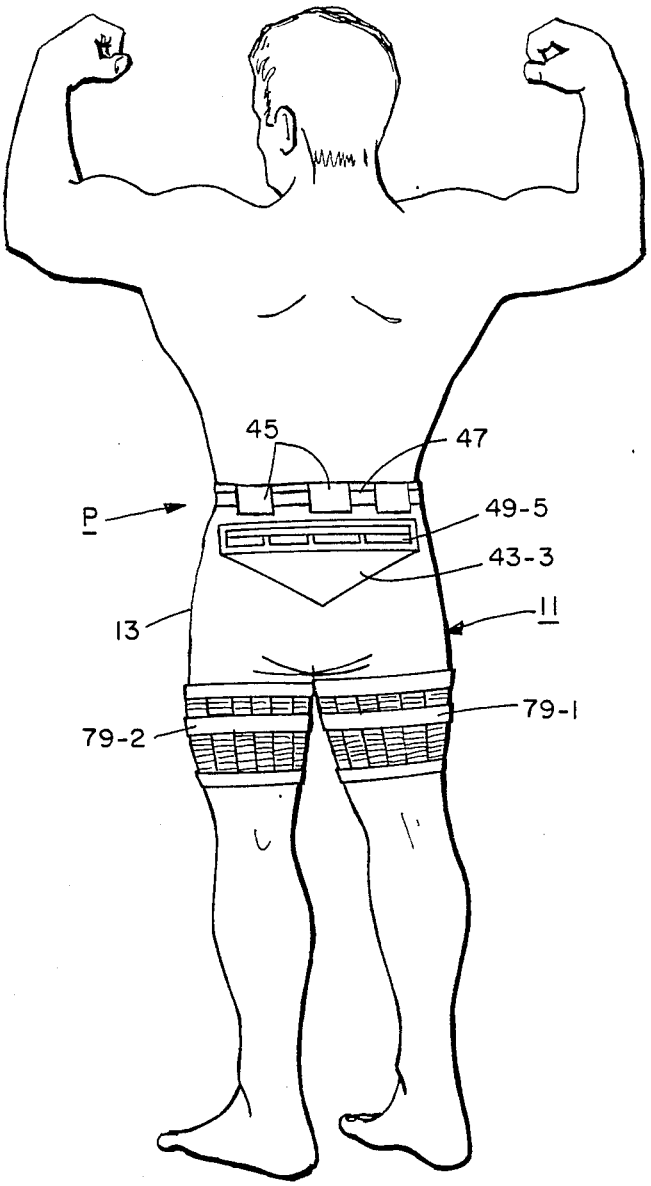
FIG. 2 is a perspective view taken from the rear of a person wearing the athletic legwear shown in FIG. 1.
Figure 3:
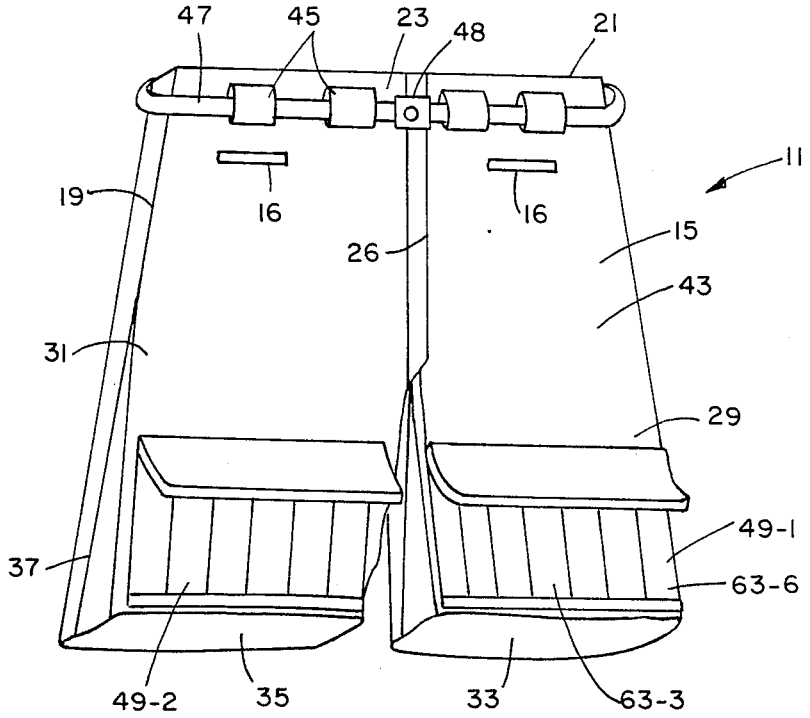
FIG. 3 is a perspective view taken from the front of the athletic legwear shown in FIG. 1 with the auxiliary belts removed.
Figure 5:
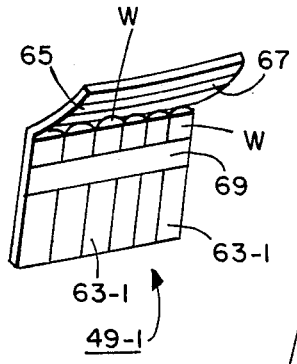
FIG. 5 is a perspective view from the front of one of the pocket assemblies in the athletic legwear shown in FIG. 1 with the cover flap open.

Referring now to the drawings, there is shown in FIGS. 1 and 2, front and back perspective views, respectively, of a person P wearing an embodiment of an athletic legwear constructed according to the teachings of the present invention, the athletic legwear being identified by reference numeral 11.

Athletic legwear 11, which is also shown in detail in FIGS. 3-11 includes a pair of pants 13. Pants 13 is made of a strong durable yet preferably lightweight fabric material such as denim, cancas or cotton and includes a front section 15 having a pair of change pockets 16 (See FIG. 3) and a back section 17 (see FIG. 4). The two sections 15 and 17 are sewn together at seams 19 and 20 so as to define a waist portion 23, a pelvic area 25, a front opening 26 having a zipper, not shown, a back area 27 and a pair of legs (i.e. leg portion) 29 and 31. Legs 29 and 31 are cut in the embodiment shown so as to define "Bermuda" length shorts. Legs 29 and 31 terminate at leg openings 33 and 35 which when the pants are worn are located a few inches above the knees. Legs 29 and 31 are cut on the sides to define a pair of elongaged inverted V shaped slots 37 which extend upward from leg openings 33 and 35, respectively, and terminate at seams 19 and 21, respectively. Slots 37 are covered with elasticized (i.e. stretch type) triangularly shaped patches 41, respectively, made of suitable jean or fabric material which are sewn onto pants 13 at seams 42. As will become apparent later, the slots and elasticized patches enable the wearer to achieve greater leg extension than would otherwise be possible if seam 19 was to extend downward all of the way to leg openings 33 and 35. Stretchy patches 43-1, 43-2 and 43-3 are also sewn onto cutout portions formed on the inside and back portions, respectively of pants 13. A plurality of belt loops 45 are sewn on pants 13 just below the waist area 23. Belt loops 45 are sized and shaped to accommodate a waist belt 47 having a buckle 48. The reason for a belt in athletic legwear will herein after become apparent.

A plurality of pocket assemblies (see FIGS. 3 and 6) labelled 49-1 through 49-5 are removably attached to pants 13. Pocket assembly 49-1 is located in the front of pants 13 on leg 29 near the bottom and pocket assembly 49-2 is located on a similar position on leg 31. Pocket assembly 49-3 is located in the back of pants 13 on leg 29 near the bottom and pocket assembly 49-4 is located in the back of pants 13 on leg 31 near the bottom. Pocket assembly 49-5 is located in the back of pants 13 below belt loops 45. Pocket assemblies 49 are removably attached to pants 13 by means of mating hook and loop patches as will hereinafter be described.

Figure 8:
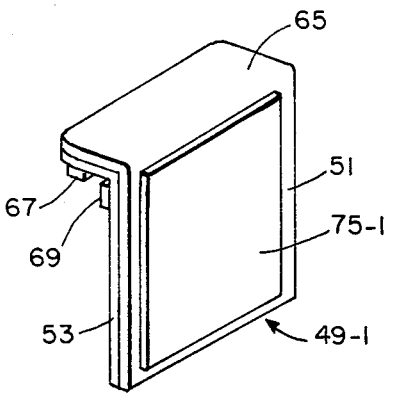
FIGS. 8 and 8(*a*) are back perspective and side section views, respectively, of the pocket assembly shown in FIG. 7.
Figure 7:
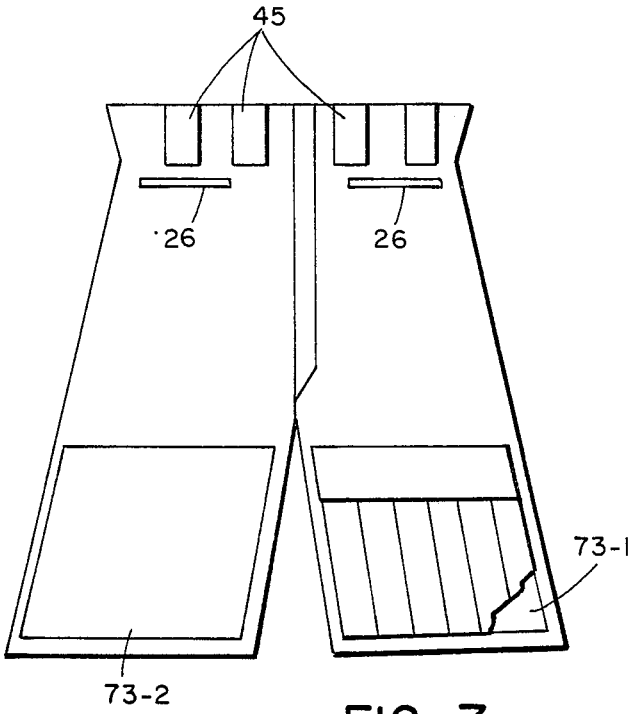
FIG. 7 is a front elevation view of the athletic legwear shown in FIG. 1 partly broken away and with one pocket assembly removed.
Figure 8A:
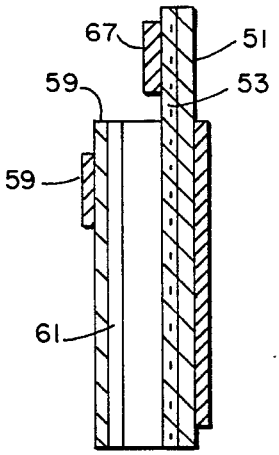
Figure 8B:
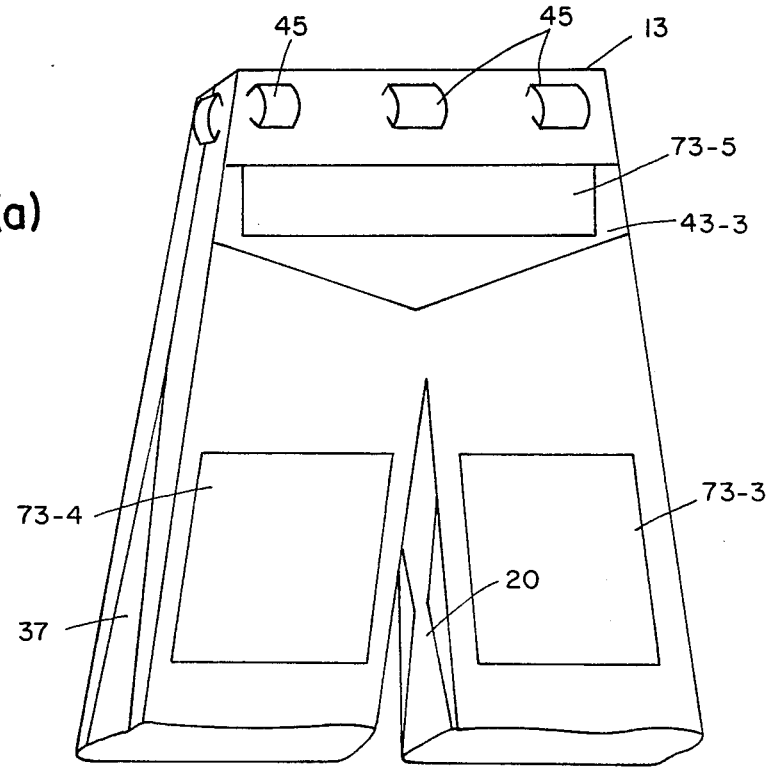
Figure 9:
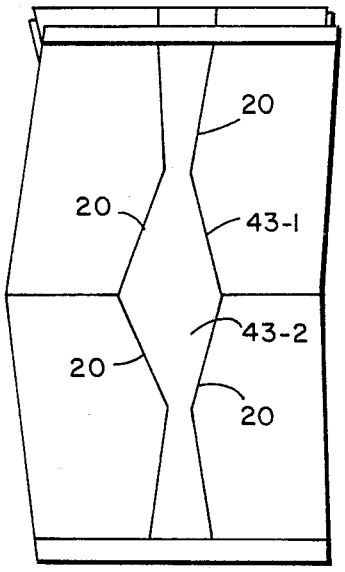
FIGS. 9 and 10 are side views of the athletic legwear shown in FIG. 1, one pant leg being lifted up in FIG. 9.
Figure 10:
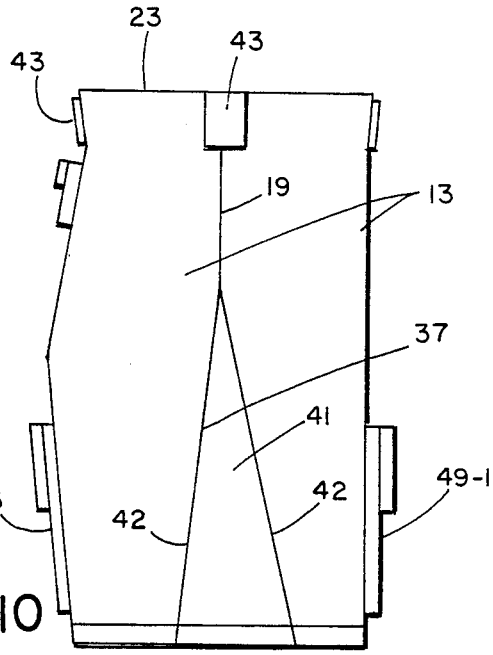

Pocket assembly 49-1 (See FIG. 8(*a*) comprises a back sheet 51 of canvas or other similarly durable yet lightweight material. A thin sheet 53 of waterproof and shock absorbing material is sewn onto the front of sheet 51. Pocket assembly 49-1 further includes a front sheet 59 of canvas or other similar material having a waterproof and shock absorbing sheet 61 sewn on the back. Front sheet 59 is sewn onto back sheet 51 in a manner so as to form a plurality of vertically oriented pockets 63-1 through 63-6, open at their tops, with the top area 65 of back sheet 51 serving as a top flap or cover for the pockets. As can be appreciated, sheets 55 and 61 serve as shock absorbers to prevent weights which may be placed inside pocket assembly from irritating the leg of the wearer during the exercising. A hook and loop patch 67 is fixedly secured to the front of sheet 53 at the top area 65 and a hook and loop 69, which can matingly engage with hook and loop patch 67, is fixedly secured to the front of front sheet 59 so that the pockets can be closed off when desired. For example, patch 67 may be hook and loop hooks and patch 69 hook and loop loops. Pockets 63 are sized to snugly hold weights W in a vertical orientation.

Pocket assemblies 49-2 through 49-4 are similar in construction to pocket assembly 49-1.

Pocket assemby 49-5 differs from pocket assembly 49-1 in that the pockets 71-1 through 71-4 in pockets assembly 49-5 are oriented horizontally end-to-end rather than vertically so that weights W, when placed in the pockets, will be distributed horizontally over the back pelvic area.

It should be noted that the number of pockets in each pocket assembly is a matter of choice.

Pocket assemblies 49-1 through 49-5 are removably attached to pants 13 hook and loop patches 73 and 75 which are fixedly attached to the pants and to the backs of the pocket assemblies, respectively. Hook and loop patches 73-1 through 73-5 are fixedly mounted by sewing or other equivalent means on pants 13. Hook and loop 73-1 through 73-4 are disposed on legs 29 and 31, patches 73-1 and 73-2 being on the front and patches 73-3 and 73-4 being on the back. Hook and loop patch 73-5 is disposed on the back side of pants 13 in the pelvic region 25. A hook and loop patch which can matingly engage with the appropriate one of hook and loop patches 73 and sized accordingly is formed on the back sheet 51 of each pocket assembly. In pocket assembly 49-1, the hook and loop patch is identified by reference numeral 75-41. For example, patches 73 may be hook and loop hooks and patches 75 may be hook and loop loops.

Figure 4:
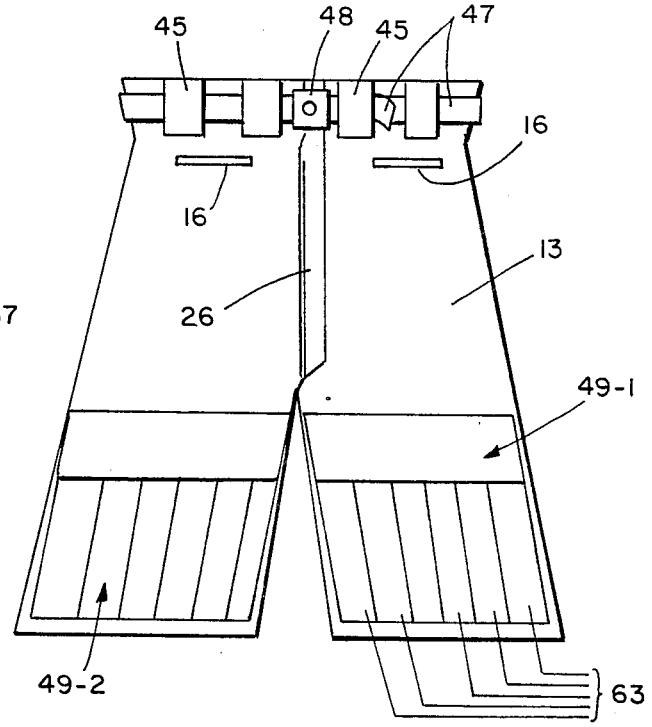
FIG. 4 is a front elevation view of the athletic legwear shown in FIG. 1 with auxiliary belts removed.
Figure 4A:
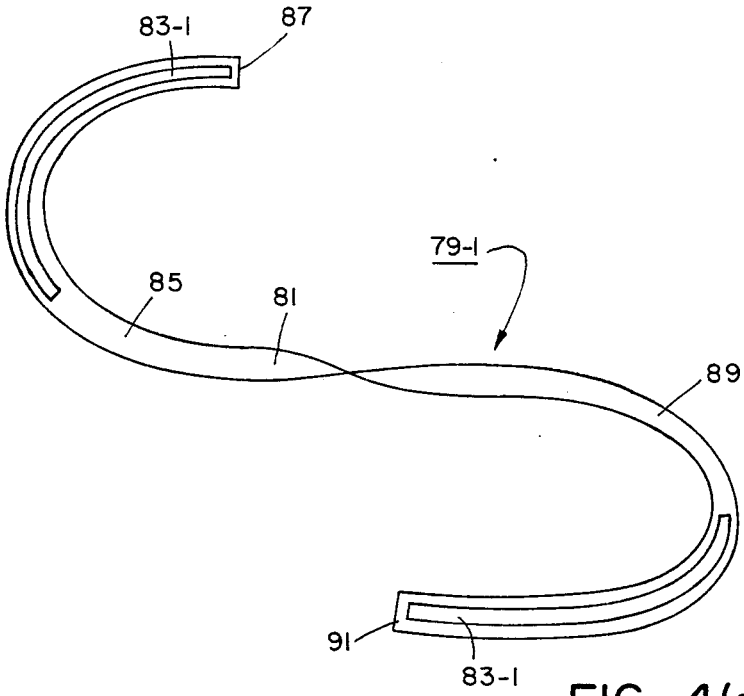
Figure 6:
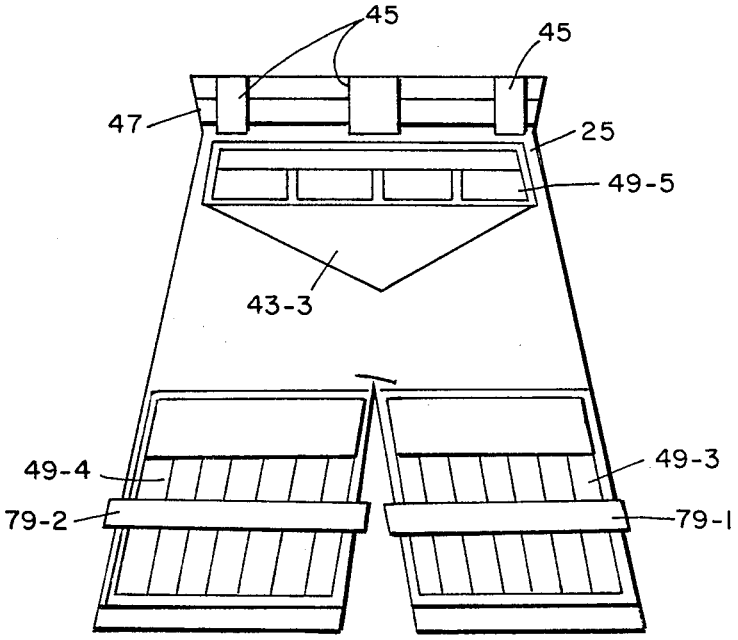
FIG. 6 is a rear view of the athletic legwear shown in FIG. 1.

Referring back to FIGS. 1 and 2, a pair of removable auxiliary supporting belts or straps 79-1 and 79-2 are wrapped around legs 29 and 31 to assist in tightly securing pocket assemblies 49-1 through 49-4 to pants 13, if desired. One of the belts 79-1 is shown in FIG. 4(*a*). As can be seen, belt 79-1, includes an elongated strap 81 and pair of mating hook and loop strips 83-1 and 83-2. Strap 81, which is made of canvas, leather, or other similar material has a front side 85, a first end 87, a back side 89 and a second end 91. Elongaged hook and loop strips 83-1 and 83-2 are sewn lengthwise along belt 79-1, hook and loop strip 83-1 being sewn on at first end 87 of front side 85 and hook and loop strip 83-2 being sewn on at second end 91 of back side 89. In use, one strap 79 is placed around each leg, as shown in FIG. 4 and secured in place by the hook and loop strips.

A third strap (not shown) may be provided to secure assembly 49-5 to pants 13 in a similar manner.

To assemble and use athletic legwear 11, the wearer first puts on pants 13 in the ordinary manner without the pockets assemblies. If the wearer does not widh to exercise with weights, he need do nothing further. However, if the wearer wishes to exercise with weights, he simply inserts one or more weights W into the pockets 63 of pocket assemblies 49, the number of weights W inserted into any given pocket assembly 49, the size of the weights W placed in the individual pockets and the number of pocket assemblies 49 used at any one time being wholly within the discretion of the wearer. After the weights W have been inserted into the pockets of the pocket assemblies 49, the flaps on pocket assemblies 49 are closed and locked shut by the Velcro patches 67 and 69. The reason for closing the pocket assemblies is so that the chances of losing a weight during exercise or of having a weight move around inside pocket 36 to the injury of the wearer can be minimized. The pocket assemblies 49 are then attached to pants 13. If a considerable amount of weight has been added to pants 13, the wearer may wish to put a belt 47 on pants 13 to prevent pants 13 from slipping down the legs of the wearer during exercise. If the wearer so desires, belt 47 is secured to pants 13 by threading the belt through belt loops 45 in the ordinary fashion. To ensure that pocket assemblies 49 will not inadvertantly disengage from pants 13 during exercise, the wearer may wrap auxiliary belts 79 around the pocket assemblies using the Velcro strips 83 to securely bind belts 79 about pants 13. The wearer is now ready to exercise. The wearer need not use all five pocket assemblies at one time. Instead, the wear may only use assemblies 49-1 and 49-2 (the two assemblies in the front) or only use assemblies 49-1 through 49-4 or for that member any other combination desired.

Figure 11:
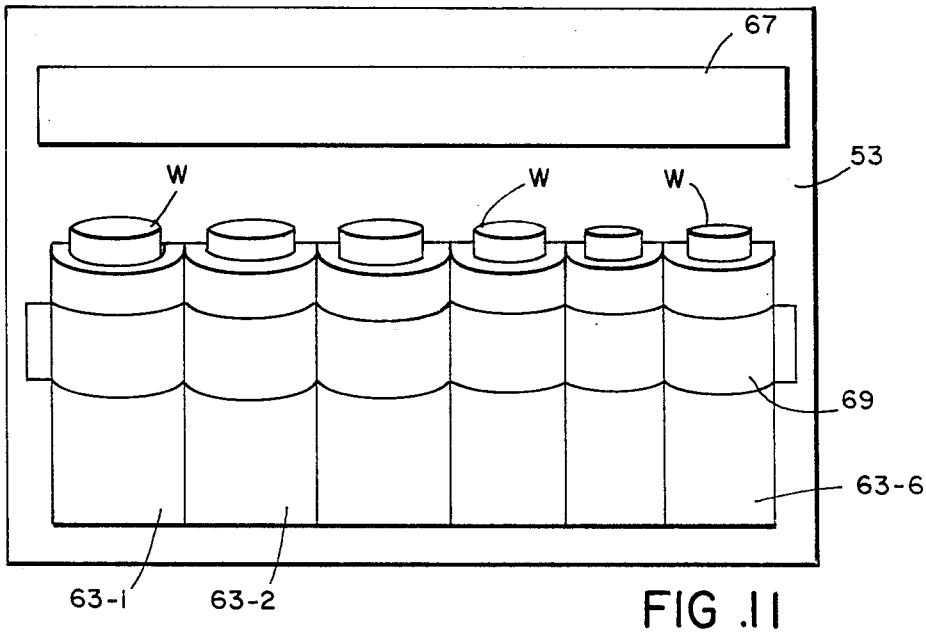

In another embodiment of the present invention, (See FIG. 11(*a*)) each pocket assembly 149 is permanently filled with a unique, pre-determined number of weights, giving each pocket assembly a fixed weight the flaps being sewn shut at seams 91. The wearer merely selects the pocket assembly having the weight he desires and then attaches the pocket assembly (or assemblies) to the pants at the desired locations in the manner described above.

Figure 12:
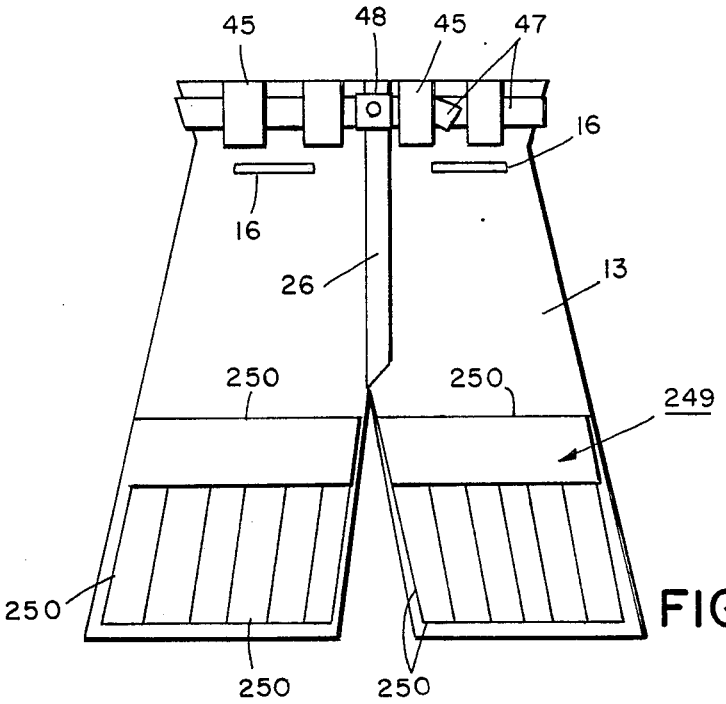
FIG. 12 is a front view showing another embodiment of the invention.

In still another embodiment of the present invention, (See FIG. 12) the pocket assemblies 249 of the type described in the first embodiment are fixedly sewn on the pants at seams 250 rather than being removably attached.

Figure 13:
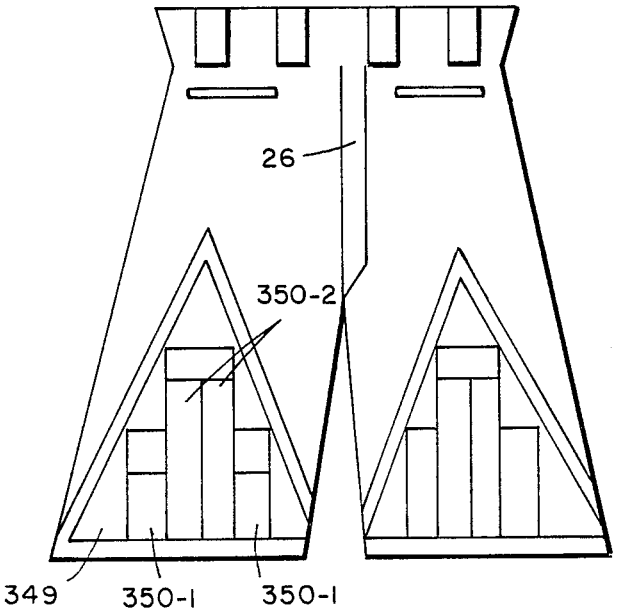
FIG. 13 is a front view of another embodiment of the invention.
Figure 14:
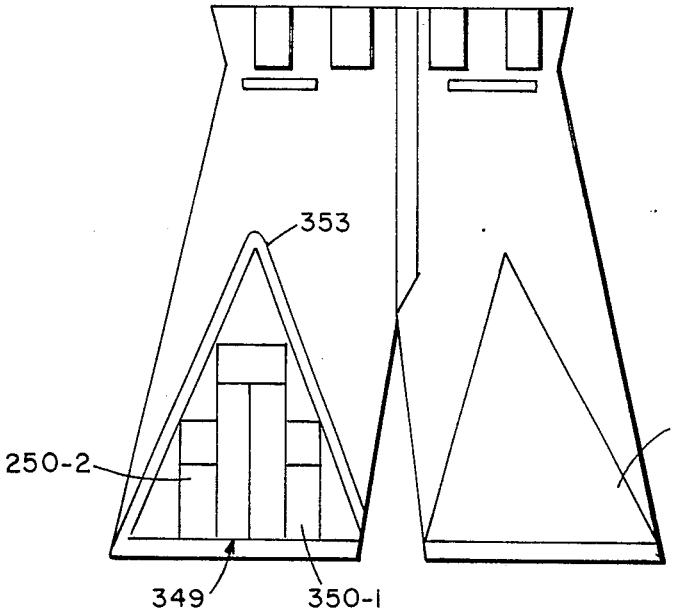
FIG. 14 is a front view of the embodiment shown in FIG. 13 with one pocket assembly removed.
Figure 15:
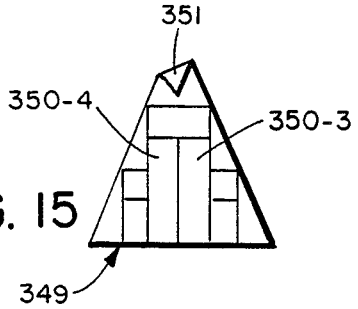
FIG. 15 is a front view of one of the pocket assemblies shown in FIG. 13.
Figure 16:
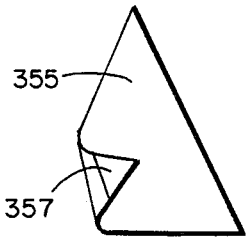
FIG. 16 is a front view of an auxiliary patch useable with the embodiment in FIG. 13.

In still yet another embodiment of the present invention, (See FIGS. 13-15) pocket assemblies 349 having different sized pockets 350 to accommodate different sized weights (i.e. pockets 350-1 and 350-2 being sized to hold one pound weights and pockets 350-3 and 350-4 for being sized to hold two pound weights) are removably attached to the pants by mating hook and loop pads 351 and 353. If an assembly 349 is not being used, the exposed hook and loop pad 353 on the pants may be temporarily covered with a pad 355 having hook and loop portions 357 (See FIG. 15).

If desired, pants 13 can be used without any of the pocket assemblies.

The embodiments of the present invention are intended to be merely exemplary and those skilled in the art shall be able to make numerous variations and modifications to it without departing from the spirit of the present invention. For example, the legwear may be in the form of long pants rather than shorts. All such variations and modifications are intended to be within the scope of the present invention as defined in the appended claims.

What is claimed is:

1. Athletic legwear comprising:

a. a pair of pants having an exterior surface, b. a plurality of pocket assemblies, each pocket assembly having one or more pockets adapted to hold securely therein one or more weights, and c. means for removably attaching each of said pocket assemblies to said exterior surface of said pair of pants above the knee and below the waist of the wearer.

2. The athletic legwear of claim 1 and wherein said means for removably attaching each of said pocket assemblies to said pair of pants above the knee and below the waist of the wearer comprises mating hook and loop patches being fixedly mounted on said pair of pants and the other one of said mating hook and loop patches being fixedly mounted on said pocket assembly and adapted to matingly engage the Velcro patch on said pair of pants.

3. The athletic legwear of claim 2, said pocket assembly including a back member and a front member, the front member being sewn on to the back member so as to form a plurality of pockets, said back member having a top portion which serves as a cover, said pocket assembly further including means for removably attaching said cover to said front member.

4. The athletic legwear to claim 3 and wherein said means for detachably mounting said cover on said base includes a pair of mating hook and loop patches, one of said mating hook and loop patches being sewn onto said front member and the other one of said mating hook and loop patches being sewn on said cover in such an orientation that said mating hook and loop patches detachably engage when said cover is brought into physical contact with said front member.

5. The athletic legwear of claim 1 and further including removable strap means to assist in securing at least some of the pocket assemblies to the pair of pants.

6. The athletic legwear of claim 5 and further including waist belt means for holding the pants in place on the wearer.

7. The athletic legwear of claim 6 and wherein the pants includes elasticized sections which enable the wearer to achieve increased leg extension.

8. Athletic legwear to be worn by a person while engaged in aerobic exercise for the purpose of increasing the strength of the leg muslces of the wearer, said athletic legwear comprising:

a. a pair of pants having an exterior surface, and b. a plurality pocket assemblies removably attached to said exterior surface of said pair of pants above the knee and below the waist of the wearer, each pocket assembly having one or more pockets adapted to hold securely therein one or more weights, one of said pocket assemblies being removably attached to the back of the pair of pants around the pelvic area.

9. Athletic legwear comprising:

a. a pair of pants having an exterior surface, b. a plurality of pocket assemblies removably attached to said exterior surface of said pair of pants, each pocket assembly comprising a plurality of pockets adapted to hold securely one or more weights, said plurality of pocket assemblies including a first pocket assembly located on the front of one of the legs of the pants between the waist and the knee, a second pocket assembly located on the rear of the same leg of the pants between the waist and the knee, a third pocket assembly located on the front of the other leg between the waist and the knee, a fourth pocket assembly located on the rear of the other leg between the waist and the knee and a fifth pocket assembly located on the rear of the pants at the pelvic area.

c. removable strap means to assist in holding the first, second, third and fourth pocket assemblies on the pants, and d. belt means to assist in holding the pants on the wearer.

* * * * *